United States Patent [19]

Janberg et al.

[11] Patent Number: 4,508,969

[45] Date of Patent: Apr. 2, 1985

[54] DEVICE FOR HOLDING, TRANSPORTING AND FINAL STORING OF BURNED-OUT REACTOR FUEL ELEMENTS

[75] Inventors: Klaus Janberg, Ratingen; Hans-Peter Dyck, Burgdorf, both of Fed. Rep. of Germany

[73] Assignee: Deutsche Gesellschaft für Wiederaufarbeitung, Fed. Rep. of Germany

[21] Appl. No.: 277,348

[22] Filed: Jun. 25, 1981

[30] Foreign Application Priority Data

Jun. 28, 1980 [EP] European Pat. Off. ..... 80103681.5

[51] Int. Cl.[3] ..... G21F 5/00

[52] U.S. Cl. ..... 250/506.1

[58] Field of Search ..... 250/506.1, 507.1; 376/272; 164/110, 111

[56] References Cited

U.S. PATENT DOCUMENTS

| | | | |
|---|---|---|---|
| 121,036 | 11/1871 | Aiken | 164/111 |
| 1,929,365 | 10/1933 | Mautsch | 164/109 |
| 2,095,055 | 10/1937 | Campbell et al. | 164/111 |
| 2,305,150 | 12/1942 | Fearon | 164/111 |
| 2,363,272 | 11/1944 | Taeyaerts et al. | 164/110 |
| 3,573,462 | 4/1971 | Wilkins et al. | 250/506.1 |
| 3,575,601 | 4/1971 | Linsay et al. | 250/506.1 |
| 3,883,745 | 5/1975 | Glasser | 250/506.1 |
| 4,040,480 | 8/1977 | Richards | 250/506.1 |
| 4,274,007 | 6/1981 | Baatz et al. | 250/506.1 |
| 4,326,918 | 4/1982 | Lapides | 250/506.1 |

*Primary Examiner*—Alfred E. Smith
*Assistant Examiner*—Carolyn E. Fields
*Attorney, Agent, or Firm*—Allegretti, Newitt, Witcoff & McAndrews, Ltd.

[57] ABSTRACT

The invention relates to a device for holding, transporting and final storing burned-out reactor fuel elements comprising a hollow-cylindrical container that can be closed with a cover. On its sealing surface which is opposite the cover, the container is provided with projections which are of dovetail profile. The cover is cast onto the container around the dovetail projections by means of a casting mold whereby an intimate and firm connection between the container jacket and the cover can be produced. The cover can also be prefabricated with filler channels for directing metal casting material into recesses provided in the sealing surface of the cover. When the metal hardens in the recesses the cover is securely locked to the container. The container may have a shielding cover beneath the top cover.

7 Claims, 19 Drawing Figures

DEVICE FOR HOLDING, TRANSPORTING AND FINAL STORING OF BURNED-OUT REACTOR FUEL ELEMENTS

The invention relates to a container for storing radioactive materials such as burned-out reactor fuel elements.

THE PRIOR ART

Containers having a cylindrical shape and which hold several fuel elements and can be closed with a cover have been previously disclosed. The loaded containers are put individually or several collectively into boreholes (vertical, horizontal or slanting boreholes) which are provided in the final storage place for instance, a salt mine. To facilitate transporting and handling the containers, they must be limited in size and weight.

Special problems result during the production, transporting and final storing of such containers regarding corrosion, shielding against gamma radiation and neutron radiation, sealing, and strength of the connection between the container and the container cover, as well as regarding the reusability of the container and parts thereof.

In order to prevent corrosion it has been proposed, depending on environment conditions, to fabricate the container from carbon-steel, high-grade steel or spheroidal graphite iron (GGG). For shielding against gamma radiation it has been known to use lead or other materials, which shield against rays and have a low melting point. For shielding against neutron radiation, hydrocarbons, for instance, polyethylene, have been used.

THE INVENTION

The object of the present invention is to provide a container of the type described having an absolutely tight, firm and secure connection between the container and the container cover.

According to the invention this object is achieved by casting the cover from metal around connector elements projecting from the outer edge of the container wall surrounding the open end. The outer end of said elements are enlarged so that the connection to the cast cover is gastight and mechanically secure. The construction of the invention makes possible the casting of the cover after the loading of the container whereby an intimate connection on the sealing surfaces between cover and container is achieved so that perfect shielding also is obtained in the area of the sealing surface. The strength of the connection is sufficient to enable lifting the container by the cover.

THE DRAWINGS

The invention will be explained now in detail by means of the attached drawing in which embodiments are illustrated.

FIG. 1 shows schematically a section through a device constructed in accordance with the invention, FIG. 2*a* and 2*b*, show perspective views of two devices according to FIG. 1 with different interior cross-sectional configurations, FIG. 3 shows a section through one embodiment of the device according to FIG. 1 in the cover zone of the container, FIGS. 4, 5, 6 and 7 show sections in the cover zone of other embodiments of the invention, FIGS. 8 to 11 are sectional views similar to FIGS. 4–7 showing further embodiments of the device, FIG. 12 shows model configurations for the projections or ribs that may be used in locking the cover to the container, FIG. 13 shows a model configuration of a recess formed in the wall of the container, and FIG. 14*a* and *b* shows model configurations for inside containers or liners insertable into the container. In the drawing the same structural parts carry the same reference numerals.

DETAILED DESCRIPTION

Figure 1:
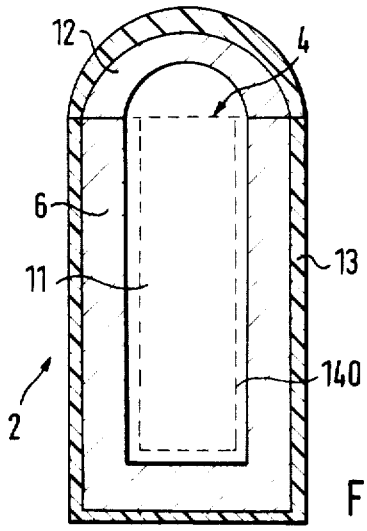
Figure 2A:
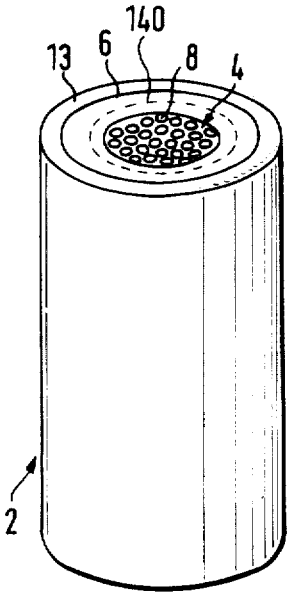
Figure 2B:
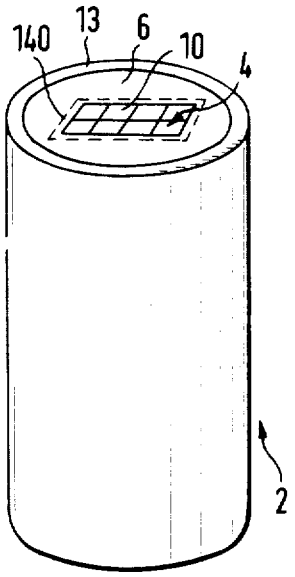

FIGS. 1 and 2 show a device 2 having a hollow-cylindrical container 6 open at the top 4 for holding, transporting and final storing of fuel elements 8 and 10. The interior 11 of the container can be circular-cylindrical (FIG. 2*a*) or rectangular or polygonal (FIG. 2*b*) in cross section.

The container 6 is closed with a cover 12. The wall of the container 6 preferably is made in one piece, but it can also be made of several pieces. Carbon steel or high-grade steel is used as the fabricating material if the container walls are not too thick. With greater wall thickness carbon steel or spheroidal graphite iron is used. The wall thickness is selected such that gamma radiation is absorbed; thus, for instance, a thickness of 200 mm is sufficient to meet transportation limit values of 200 mrem/h on the surface. Spheroidal graphite iron has the advantage of a favorable price combined with ductility and a good shielding effect. The wall thickness also depends on the formation of the final storage place and on the corrosion induced by the environment on the container. Beyond that, of course, economic considerations are also important. A separate removable temporary outer shielding of spheroidal graphite iron can be used during transportation of the container and thus minimize the wall thickness of the final storage container. Such a design may have double walls and consist of an outer container and an inner container; this will be described in more detail with reference to FIG. 14.

The peripheral shape of the container 6 is preferably circular because circular boreholes into which the containers are placed for the purpose of final storing are simpler to prepare.

Surrounding the container 6 proper a cylindrical shielding layer 13, for instance, of a hydrocarbon such as polyethylene, in order to absorb the residual neutron radiation in the burned-out reactor elements. As a rule, 3 to 4 cm wall thickness are sufficient. This shielding is connected to the container in such a way that after transporting the container into the final storage place it can be removed for reuse.

The free volume in the hollow space of the container can be filled by pouring in a filling material to improve the stability and the shielding against gamma radiation. Lead is especially suited for this purpose. The free volume to be filled in this manner, for compressed water reactor fuel elements, totals approximately 300 liters per fuel element in the case of a Biblis fuel element and to approximately the same amount in the case of four boiling water reactor fuel elements.

Figure 3:
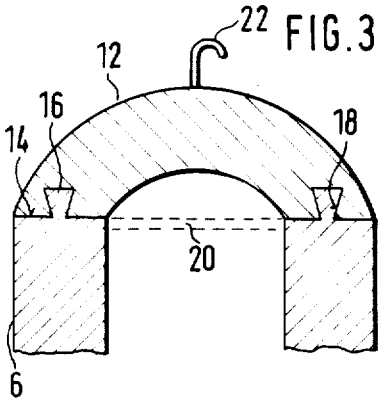
Figure 4:
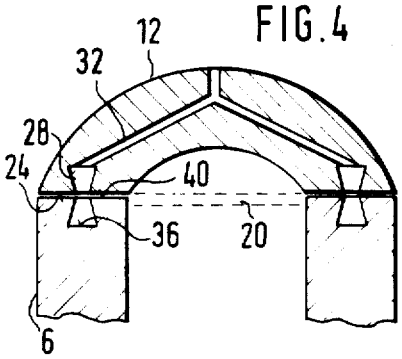

The cover 12 is gas-tight and firmly connected to the container 6. For this purpose, the upper surface 14 of the wall of the container in the area surrounding the opening 4 terminates in a circular projection 16 having a profile as shown in FIGS. 3 and 4. In FIG. 3 the projection 16 is dovetailed and formed integrally with the wall. The cover 12 is cast around the projection 16 producing a complementary recess 18 whereby a very firm and tight connection of cover and container is achieved.

To produce this connection a hollow mold is placed on the container after the fuel elements have been placed in the container and the hollow space was closed with a flat shielding cover 20 of high-grade steel (the shielding cover is drawn only schematically; details regarding its arrangement and special design will be given below in a more detailed manner with reference to FIG. 8). The mold is filled by pouring in a molten material, preferably the same material of which the container proper consists, whereby after the hardening of the poured material an intimate connection with the container is produced which is so firm that lifting of the container is possible, for instance, by means of a hook 22 which is cast into the cover.

Figure 6:
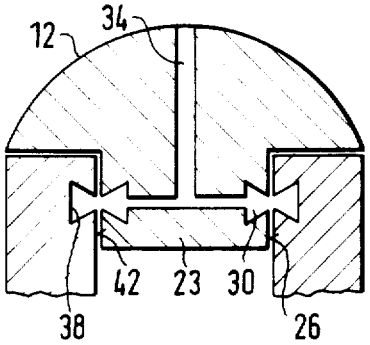
Figure 7:
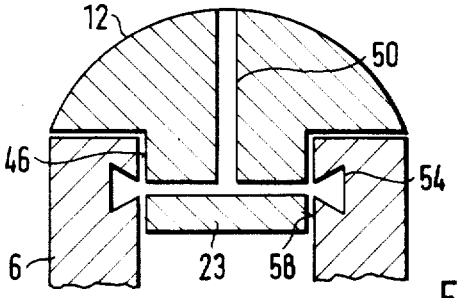

FIGS. 4 and 7 show variations of the contruction of FIG. 3 in which opposed dovetailed recesses are provided in opposed mating surfaces of the cover and container. In FIG. 7 the underside of the cover 12 is also provided with a center extension 23 insertable into the container 6 according to FIGS. 6 and 7. In these modifications, the cover 12 is already prefabricated. In the sealing surface 24, 26 of FIGS. 4 and 6 respectively, the cover is provided with dovetailed recesses 28 and 30 into which channels 32, 34 open. The recesses 28 and 30 are located opposite dovetailed recesses 36, 38 formed in the opposite sealing surfaces 40, 42 of the container 6. The channels 48 and 50 of FIGS. 5 and 7 respectively open directly into the sealing surfaces 44 and 46 of the cover at a point opposite recesses 52, 54 in the sealing surfaces 56, 58 of the con- tainer.

In order to connect the cover 12 and the container 6, casting material is fed through the channels into the recesses. When the molten material fills and hardens in the channels and recesses a firm and gas-tight connection is produced. Screw connections and sealing elements can also be provided additionally or alternatively. The projections need not be dovetailed; they can have also other suitable shapes which preferably are narrower at the sealing edge than at the base.

Figure 8:
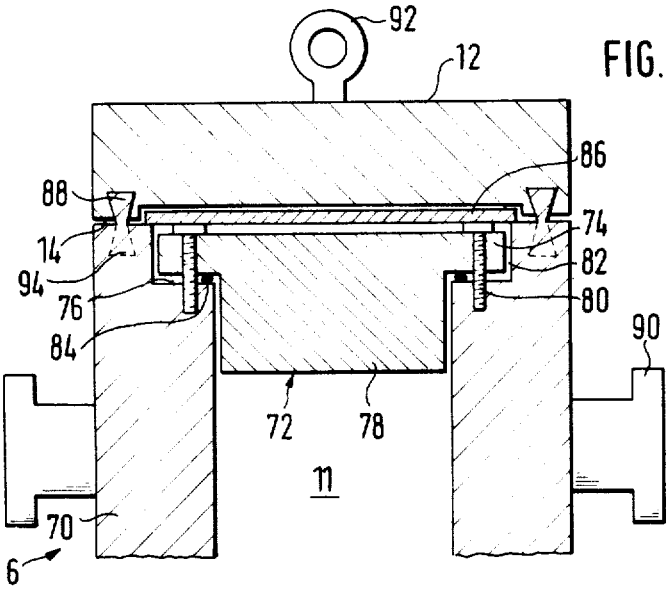

FIG. 8 shows in detail a preferred design for the cover zone of the device. The container 6, just as the container according to FIGS. 1 to 7, consists of a jacket 70, the bottom of which is not shown, and of a shielding cover 72. The shielding cover 72 has a protruding circumferential edge flange 74 which fits into a stepped recess 76 in the mouth of the jacket 70. An extension 78 of the shielding cover 72 protrudes into the hollow space 11 of the container 6. The edge flange 74 of the shielding cover 12 is secured to the jacket 70 by means of screws 80. A gasket 84 is provided for sealing the gap 82 between the shielding cover 72 and the stepped recess 76. The shielding cover preferably is made from spheroidal graphite iron.

A relatively thin plate 86 covers the shielding cover 72 as well as the screws 80 and the gap 82. The cover plate 86 is welded flush to the top surface of the jacket wall.

Above the cover plate 86 a final cover 12, as described before in connection with FIGS. 1 to 7, is cast onto the container by means of a suitable casting mold. Instead of the arched shape illustrated in FIGS. 1 to 7 the top cover can also be made flat as it is illustrated in FIG. 8. For the casting of the cover 12, the container 6 including the shielding cover and possibly the cover plate 86 is heated to a suitable temperature, for instance, 500° to 600° C. in order to preclude rapid cooling and thus obtain a uniform grain structure at the connection between cover and container jacket and prevent the development of a martensitic structure in the cast metal.

The cover plate 86 prevents connecting the cover 12 with the shielding cover 72 and the screws 80. Thereby the container remains accessible in a simple manner. The cover 12 may be removed together with the cover plate 86. Then the opening of the container is possible after the loosening of the screws and the removal of the shielding cover.

The jacket 70 is provided on its top edge with a projection 88 which may take the form of dovetailed individual segmental projections or of a dovetailed annular rib. These projections may also take other suitable shapes. After the cover 12 has been put on or cast on, the projections guarantee a firm and secure connection between the container 6 and the cover 12.

For a better handling of the container, lifting lugs 90 can be attached to the side of the jacket 70. These lifting lugs are preferably detachable. Also to facilitate handling the cover 12 can be provided with a hook 92 which is preferably detachable.

In place of projection 88, it is possible to provide in the top edge of the jacket a recess 94 (shown in broken lines) into which the casting material is fed during the casting of the cover. A mold (not shown) is placed on top of the container, into which the casting material is fed and which produces the shape of the cover.

Figure 9:
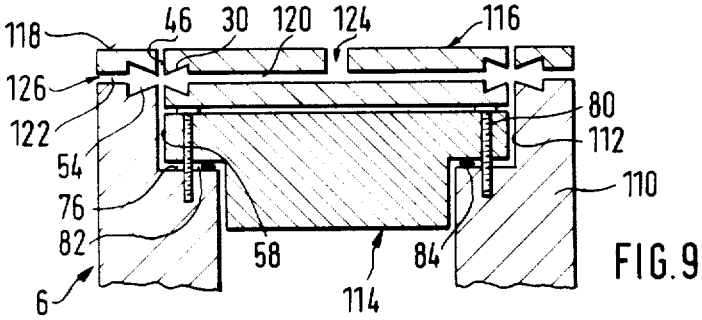
Figure 10:
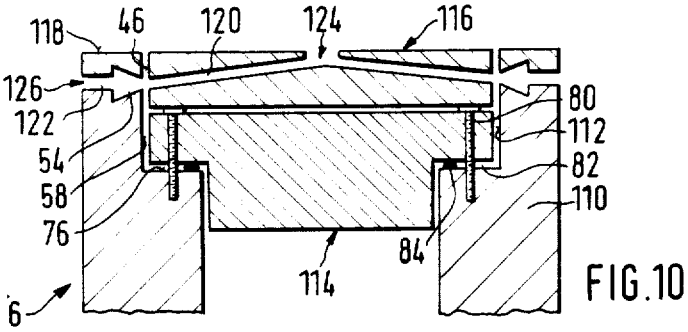

FIGS. 9 and 10 show two further variations for the cover of the container 6. In both types, the jacket 110 of the container is provided inside with a stepped recess 112 and a shielding cover 114 of similar construction to FIG. 8. A top cover 116 is recessed so that its top surface 118 is spaced slightly above the top surface of the jacket wall. For this type, the cover 116 is prefabricated and has channels 120 which open into the lateral surfaces of the cover opposite channels 122. As illustrated, parts of the channels can be dovetailed as described before in connection with FIGS. 4 to 6. After the prefabricated cover has been put on, casting material is fed into those channels and into dovetailed recesses 30 by way of filling orifices 124 and 126. Upon solidification the solid metal results in a firm connection between cover and container.

Figure 5:
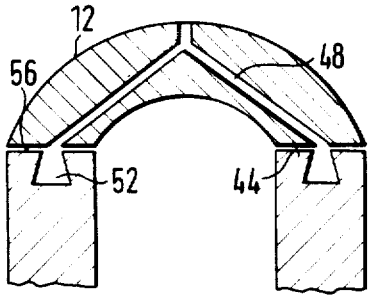
Figure 11:
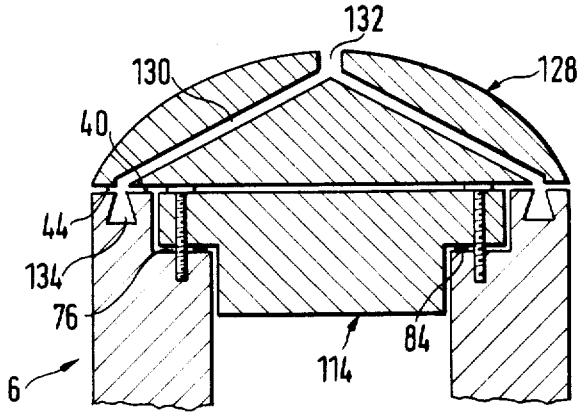

FIG. 11 shows another modification in the cover zone of the container 6 where the shielding cover 114 is designed approximately like the shielding cover according to FIG. 8 and is connected with the container. The cover 128 is also prefabricated and provided with casting channels 130 and filling orifice 132 approximately as shown in FIG. 5. It has a shape arched outwardly, for instance, like the cover according to FIGS. 3 to 5. In this construction, dovetailed recesses 134 are provided in the top edge of the jacket with which channels 130 communicate as described in connection with FIG. 5.

Figure 12A:
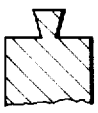
Figure 12B:
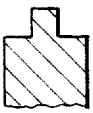
Figure 12C:
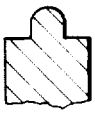
Figure 12D:
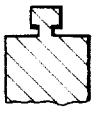

In FIG. 12*a, b, c, d,* some examples of cross section shapes suitable for the projections on the top surface of the container jacket are shown. The shapes according to FIG. 12*a* and 12*d* result in a firmer connection because of the undercut design and are preferred.

Figure 13:
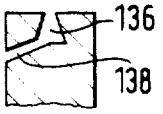

FIG. 13 shows recesses 136, formed in the wall of jacket 70 of the container 6, with air bleed ducts 138 in order to ensure that the recess is completely filled with casting material.

Figure 14A:
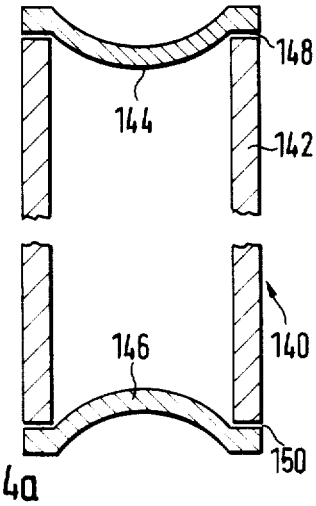
Figure 14B:
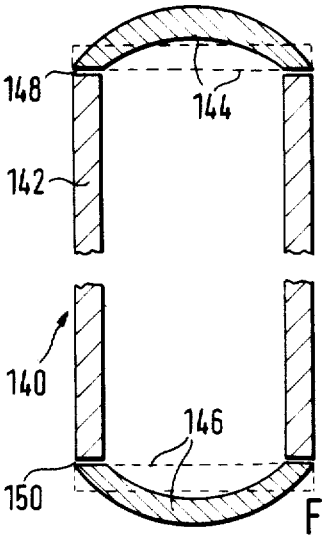

FIG. 14*a* and 14*b* show a separate inner container 140 for holding fuel elements. The inner container consists of a jacket 142, a cover 144 and a bottom 146. Cover and bottom are welded to the jacket at 148 and 150. The bottom can be cast in one piece with the jacket, or cast on separately. The cover can be put on by casting or by welding. The cover and the bottom can be arched inward (FIG. 14*a*), arched outward (FIG. 14*b*), or also be straight (shown by broken lines in FIG. 14*b*). During transporting, the inner container is inserted into an outer container or transport container which is designed like the container according to FIGS. 1 to 13; compare especially FIGS. 1, 2*a* and 2*b* in which the inside container 140 is shown in broken lines and the outer container comprises the container 6.

Such a double-container has several advantages. In connection with the final storing, only the inner container is lost. The outer container can be reused; it can be salvaged during the transfer at the borehole of the final storage site.

The inner container and the outer container can be constructed from the same materials and in the same manner. High-grade steel or casting material is also preferable for the inner container. If carbon steel is used, ceramic material or another corrosion-protecting layer is put on. Preferably the outer shape of the inner container corresponds to the inner shape of the outer container. The thickness of the material for the inner container is selected in such a way that the minimum requirements regarding the shielding effect and the stability are met. The outer container must be constructed so that transportation specifications are met and protection against corrosion is guaranteed. For protection against corrosion the container can be provided with a ceramic layer. This can be carried out, for instance, by the spraying on the appropriate material.

For reasons of completeness there may also be mentioned that a lock system can be provided in the zone of the cover in order to make it possible to take a sample from the container and to carry out supervisory tasks.

What is claimed is:

1. A device which can be converted into a container for holding, transporting and finally storing burned-out reactor fuel elements comprising an open-ended cylindrical container having a sealing surface around said open end, a cover for said open end having a sealing surface for mating with said container sealing surface, an undercut recess in the sealing surface of said open end, and channels running through said cover communicating with said undercut recess at one end and with the space outside the cover at the other end.

2. A device for holding, transporting and finally storing burned out reactor fuel elements comprising an open-ended cylindrical container having a sealing surface around said open end, a cover for said open end having a sealing surface for mating with said container sealing surface, characterized in that one sealing surface has an annular undercut recess, said recess being enlarged below said surface, the other sealing surface has an integral annular projection of a shape complementary to said undercut recess, said projection being disposed in said recess.

3. The device of claim 2 in which said projection comprises a rib of dovetailed cross-section on said container sealing surface and said cover sealing surface comprises cast metal enclosing said dovetailed rib.

4. The device of claim 2 in which said recess is in said container sealing surface, said cover has channels communicating with said recess, and said channels and said recess are filled with cast metal.

5. The device of claim 2 in which said cover has a depending central boss extending into the interior of said container.

6. The device of claim 2 which includes a shielding cover secured to the container and a cover plate overlying said shielding cover and underlying said container cover.

7. The device of claim 2 which includes an inner container for holding the fuel elements disposed within said container.

* * * * *